US009711890B1

(12) United States Patent
Lai et al.

(10) Patent No.: US 9,711,890 B1
(45) Date of Patent: Jul. 18, 2017

(54) CONNECTOR COVER, CONNECTOR AND CONNECTOR MODULE

(71) Applicant: GIGA-BYTE TECHNOLOGY CO.,LTD., New Taipei (TW)

(72) Inventors: Chih-Ming Lai, New Taipei (TW); Yung-Shun Kao, New Taipei (TW); Chung-Wei Chiang, New Taipei (TW)

(73) Assignee: GIGA-BYTE TECHNOLOGY CO.,LTD., New Taipei (TW)

( * ) Notice: Subject to any disclaimer, the term of this patent is extended or adjusted under 35 U.S.C. 154(b) by 0 days.

(21) Appl. No.: 15/188,996

(22) Filed: Jun. 22, 2016

(30) Foreign Application Priority Data

Jan. 20, 2016 (TW) ..... 105101664 A

(51) Int. Cl.

| | |
|---|---|
| ***H01R 13/6581*** | (2011.01) |
| ***H01R 13/516*** | (2006.01) |
| ***H01R 12/73*** | (2011.01) |
| ***H01R 43/18*** | (2006.01) |

(52) U.S. Cl.
CPC ..... *H01R 13/516* (2013.01); *H01R 12/737* (2013.01); *H01R 43/18* (2013.01)

(58) Field of Classification Search
CPC ..... H01R 13/6581; H01R 13/65802; H01R 23/6873; H01R 23/025; H01R 23/688; H01R 23/7073
USPC ..... 439/607.35–607.4
See application file for complete search history.

(56) References Cited

U.S. PATENT DOCUMENTS

| | | | | |
|---|---|---|---|---|
| 6,083,046 A * | 7/2000 | Wu | H01R 13/65802 | 439/607.4 |
| 6,267,624 B1 * | 7/2001 | Wu | H01R 23/6873 | 439/607.35 |
| 6,494,741 B2 * | 12/2002 | Handa | H01R 12/716 | 439/607.28 |
| 6,971,915 B1 * | 12/2005 | Mao | H01R 13/6485 | 439/607.37 |

(Continued)

FOREIGN PATENT DOCUMENTS

| | | |
|---|---|---|
| TW | I275213 | 3/2007 |
| TW | M395948 | 1/2011 |
| TW | M420904 | 1/2012 |

OTHER PUBLICATIONS

"Office Action of Taiwan Counterpart Application", issued on Jun. 20, 2016, p. 1-p. 8 in which the listed references were cited.

*Primary Examiner* — Gary Paumen
(74) *Attorney, Agent, or Firm* — Jianq Chyun IP Office

(57) ABSTRACT

A connector cover is adapted to cover a connector. A fixing member of the connector protrudes from a connector lateral and includes a base portion and a top board located on the base portion. The top board and the base portion form a T shape pillar. The connector cover includes four cover laterals, and one of the cover laterals includes a concave. A position of the concave located on the cover lateral corresponds to a position of the fixing member located on the connector lateral, and a width of the concave is close to a width of base portion. When the connector cover is assembled to the connector, the cover laterals lean against the connector laterals. The base portion is located in the concave and walls of the cover lateral besides the concave is near or lean against the base portion. A connector and a connector module are further provided.

10 Claims, 11 Drawing Sheets

(56) References Cited

U.S. PATENT DOCUMENTS

| | | | | |
|---|---|---|---|---|
| 8,267,703 | B2 * | 9/2012 | Yao | H01R 24/62 439/607.36 |
| 8,740,649 | B2 * | 6/2014 | Lan | H01R 13/506 439/607.4 |
| 8,777,667 | B2 * | 7/2014 | Huang | H01R 13/65802 439/607.35 |
| 2002/0064998 | A1 * | 5/2002 | Handa | H01R 23/6873 439/607.38 |
| 2005/0095913 | A1 * | 5/2005 | Fan | H01R 23/6873 439/607.35 |
| 2006/0063432 | A1 * | 3/2006 | Chen | H01R 23/6873 439/607.36 |
| 2010/0240255 | A1 * | 9/2010 | He | H01R 12/707 439/607.35 |
| 2011/0318963 | A1 * | 12/2011 | Kamoya | H01R 12/79 439/607.35 |
| 2012/0244751 | A1 * | 9/2012 | Politsky | H01R 12/58 439/607.35 |
| 2013/0210274 | A1 * | 8/2013 | Lan | H01R 13/405 439/607.35 |

* cited by examiner

CONNECTOR COVER, CONNECTOR AND CONNECTOR MODULE

CROSS-REFERENCE TO RELATED APPLICATION

This application claims the priority benefit of Taiwan application serial no. 105101664, filed on Jan. 20, 2016. The entirety of the above-mentioned patent application is hereby incorporated by reference herein and made a part of this specification.

BACKGROUND OF THE INVENTION

1. Field of the Invention

The invention relates to a connector cover, a connector and a connector module, and particularly relates to a connector cover and a connector module capable of reinforcing a strength of a connector providing better fixing effect of an expansion card.

2. Description of Related Art

Generally speaking, a motherboard is manufactured by alternately stacking a plurality of dielectric layers and a plurality of wire layers, and a plurality of electronic components and slots are disposed on the motherboard. Since the wires are not evenly distributed, the motherboard may be slightly bent during the manufacturing process of the motherboard due to different average thermal expansion coefficients at different parts of the motherboard. In addition, due to a grasping force of the electronic components or assemblies disposed on the motherboard (e.g., an engaging force of the fan of the central processing unit to the motherboard), the motherboard may also be bent. FIGS. 1A and 1B are respectively schematic views illustrating a conventional connector disposed on a motherboard. Referring to FIGS. 1A and 1B, since a motherboard 2 is bent, a conventional connector disposed on the motherboard 2 is also defaulted slightly with the motherboard 2, making it less convenient to insert an expansion card (not shown) subsequently.

Besides, as science and technology continuously advance, the performance of expansion devices in the computer is also improved constantly. Taking memory module as an example, a memory module may generate a significant amount of heat when it is operated in a high performance mode. To accomplish a preferable heat dissipation effect, the conventional high-end memory module may include a fan disposed at a side of the memory module, so as to rapidly dissipate the heat generated by the chip of the memory module through convection. However, since this kind of memory module is heavier, the cover of the connector may crack when the memory module is inserted into the connector of the motherboard.

SUMMARY OF THE INVENTION

The invention provides a connector cover capable of preventing a connector from being warped or cracking.

The invention provides a connector module having a preferable structural strength.

A connector cover according to an embodiment of the invention is adapted to cover a connector. The connector includes a connector top surface, four connector laterals connected to each other, and a fixing member. The fixing member protrudes from one of the connector laterals and is located on the connector lateral at a position away from the connector top surface. The fixing member includes a base portion and a top board located on the base portion, and the top board and the base portion are in a form of T-shaped column. The fixing member is connected to the connector lateral through the base portion. The connector cover includes a connector top surface and four cover laterals. One of the cover laterals includes a concave at a position away from the cover top surface, the position of the concave on the cover lateral corresponds to the position of the fixing member on the connector lateral, and a width of the concave is close to a width of the base portion. When the connector cover is assembled to the connector, the four cover laterals of the connector cover respectively lean against the four connector laterals of the connector, the base portion of the fixing member is located in the concave of the cover lateral, and walls beside the concave are near or lean against the base portion.

A connector module according to an embodiment of the invention includes a connector and a connector cover. The connector includes a connector top surface, four connector laterals connected to each other, and a fixing member. The fixing member protrudes from one of the connector laterals and is located on the connector lateral at a position away from the connector top surface. The fixing member includes a base portion and a top board located on the base portion, and the top board and the base portion are in a form of T-shaped column. The fixing member is connected to the connector lateral through the base portion. The connector cover includes a connector top surface and four cover laterals. One of the cover laterals includes a concave at a position away from the cover top surface, the position of the concave on the cover lateral corresponds to the position of the fixing member on the connector lateral, and a width of the concave is close to a width of the base portion. When the connector cover is assembled to the connector, the four cover laterals of the connector cover respectively lean against the four connector laterals of the connector, the base portion of the fixing member is located in the concave of the cover lateral, and walls beside the concave are near or lean against the base portion.

According to an embodiment of the invention, the connector includes two of the fixing members, the two fixing members are located at positions near left and right ends of the connector lateral, one of the cover laterals includes two of the concaves, and the two concaves are located at positions near left and right ends of the cover lateral.

According to an embodiment of the invention, the four cover laterals are formed by bending at least one metal sheet, and two ends of the at least one metal sheet is bonded at a shorter cover lateral of the cover laterals.

According to an embodiment of the invention, a longer connector lateral of the connector laterals of the connector includes a recessed part, a longer cover lateral of the cover laterals of the connector cover includes a suspending arm, and the suspending arm is bent toward the recessed part to come into contact against the recessed part.

According to an embodiment of the invention, the connector cover further includes at least one connection pin. The at least one connection pin extends from one of the cover laterals in a direction away from the cover top surface, and the connector cover is adapted to be connected to a motherboard through the at least one connection pin.

According to an embodiment of the invention, the at least one connection pin is a ground pin, and each connection pin has a rough surface, a bending part, or a breach, and the rough surface includes a blasted surface or includes a plurality of regular or irregular strips or bumps.

A connector according to an embodiment of the invention includes a connector top surface, four connector laterals connected to each other, and a fixing member. At least two of the connector laterals are connected to the connector top surface. The fixing member protrudes from one of the connector laterals and is located on the connector lateral at a position away from the connector top surface. The fixing member includes a base portion and a top board located on the base portion, the top board and the base portion are in a form of T-shaped column, and the fixing member is connected to the connector lateral through the base portion.

According to an embodiment of the invention, the connector includes two of the fixing members, and the two fixing members are located at positions near left and right ends of the connector lateral.

According to an embodiment of the invention, a longer connector lateral of the connector laterals of the connector includes a recessed part.

Based on above, the connector cover according to the embodiments of the invention includes the cover laterals leaning against the connector laterals and the cover top surface leaning against the connector top surface. Therefore the connector module has a preferable strength. Moreover, the fixing member of the connector protrudes from the connector lateral in the form of T-shaped column, the cover lateral of the connector cover has the concave at the position corresponding to the fixing member, and the width of the concave is close to the width of the base portion of the fixing member. Thus, when the connector cover is assembled to the connector, the base portion of the fixing member is located in the concave of the cover lateral, such that the cover lateral is limited between the top board of the fixing member and the connector lateral, thereby preventing the cover lateral from being easily pulled away from the connector lateral. Moreover, since the opposing walls of the cover lateral beside the concave are near or lean against the opposing sides of the base portion located on the connector lateral, the two sides of the cover lateral with respect to the center cannot be easily bent upward or downward. Thus, the connector cover is capable of increasing an anti-bending ability of the connector. If the connector module is fixed on the motherboard, the connector module may also alleviate bending of the motherboard.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1A:
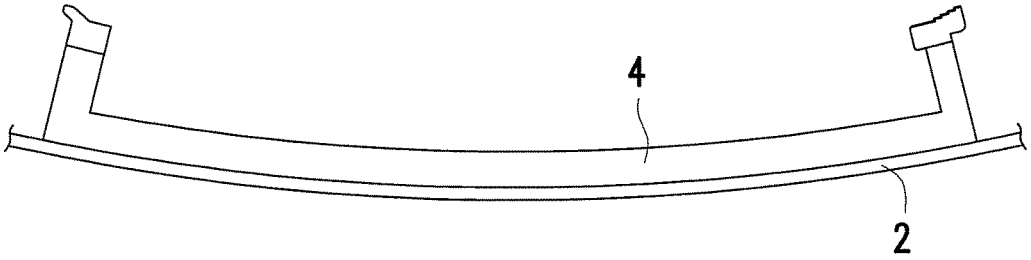
FIG. 1A(RELATED ART)
FIGS. 1A and 1B are respectively schematic views illustrating a conventional connector disposed on a motherboard.

Reference will now be made in detail to the present preferred embodiments of the invention, examples of which are illustrated in the accompanying drawings. Wherever possible, the same reference numbers are used in the drawings and the description to refer to the same or like parts.

Figure 2:
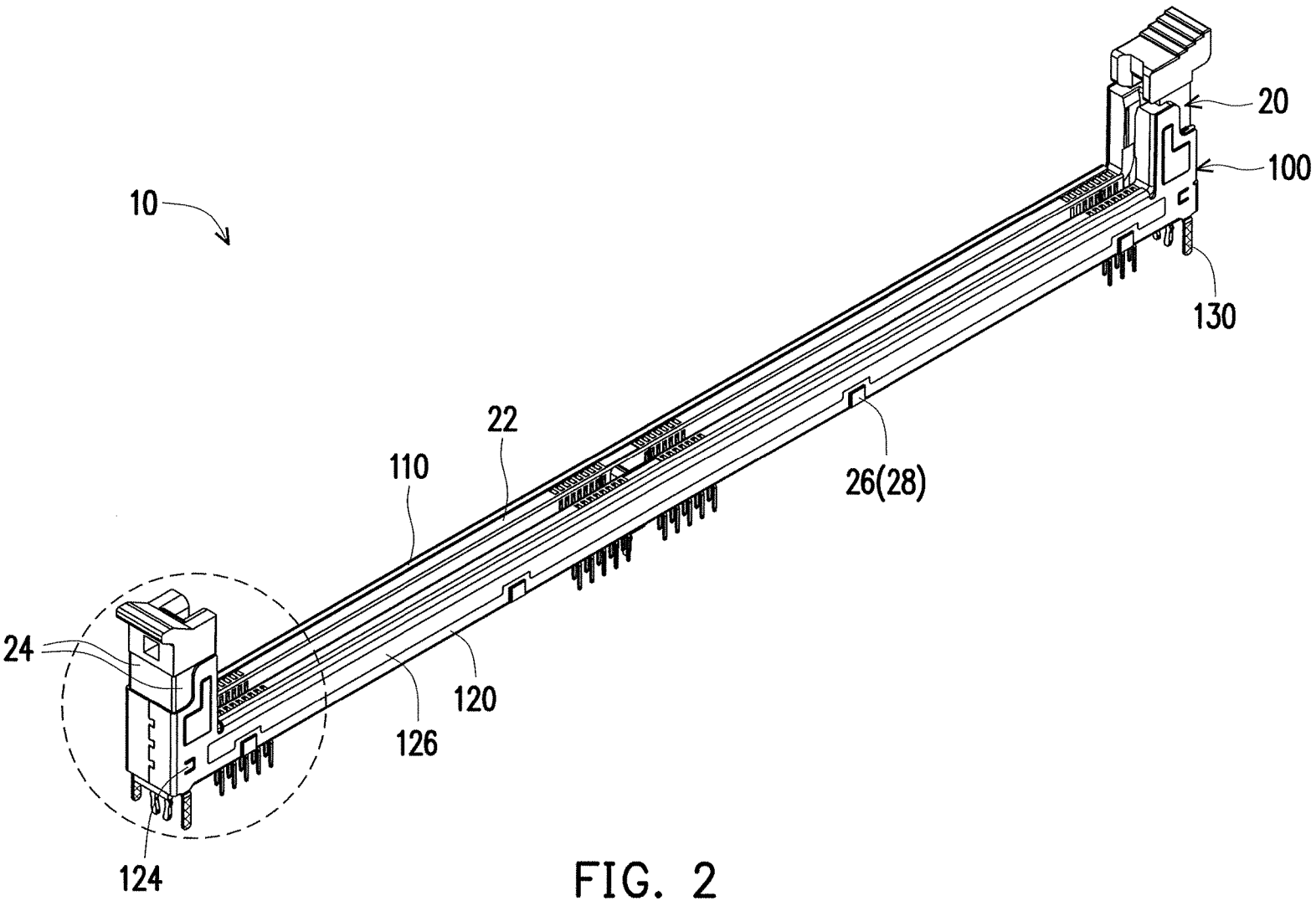
FIGS. 2 and 3 are schematic views illustrating a connector module according to an embodiment of the invention from different perspectives.
Figure 3:
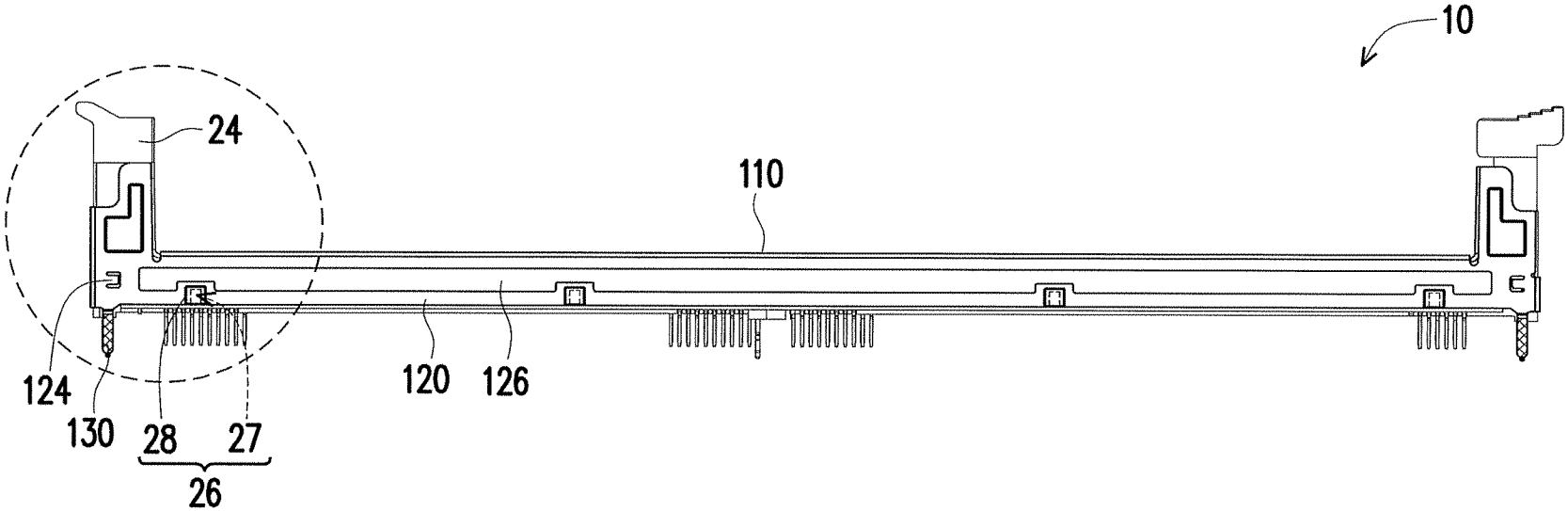

FIGS. 2 and 3 are schematic views illustrating a connector module according to an embodiment of the invention from different perspectives. Referring to FIGS. 2 and 3, a connector module 10 of this embodiment includes a connector 20 and a connector cover 100. In this embodiment, the connector 20 is described as a memory module connector, for example. However, the type of the connector 20 is not limited thereto. A connector cover 100 covers the connector 20 to provide the connector module 10 with a preferable structural strength. Besides, through a special mechanical configuration, the connector cover 100 of the connector module 10 of this embodiment may lean against the connector 20 and prevent the connector 20 from being bent easily. If the connector module 10 is disposed on a motherboard, the extent to which the motherboard (not shown) is bent may also be alleviated. In the following, details in this regard will be described.

Figure 4:
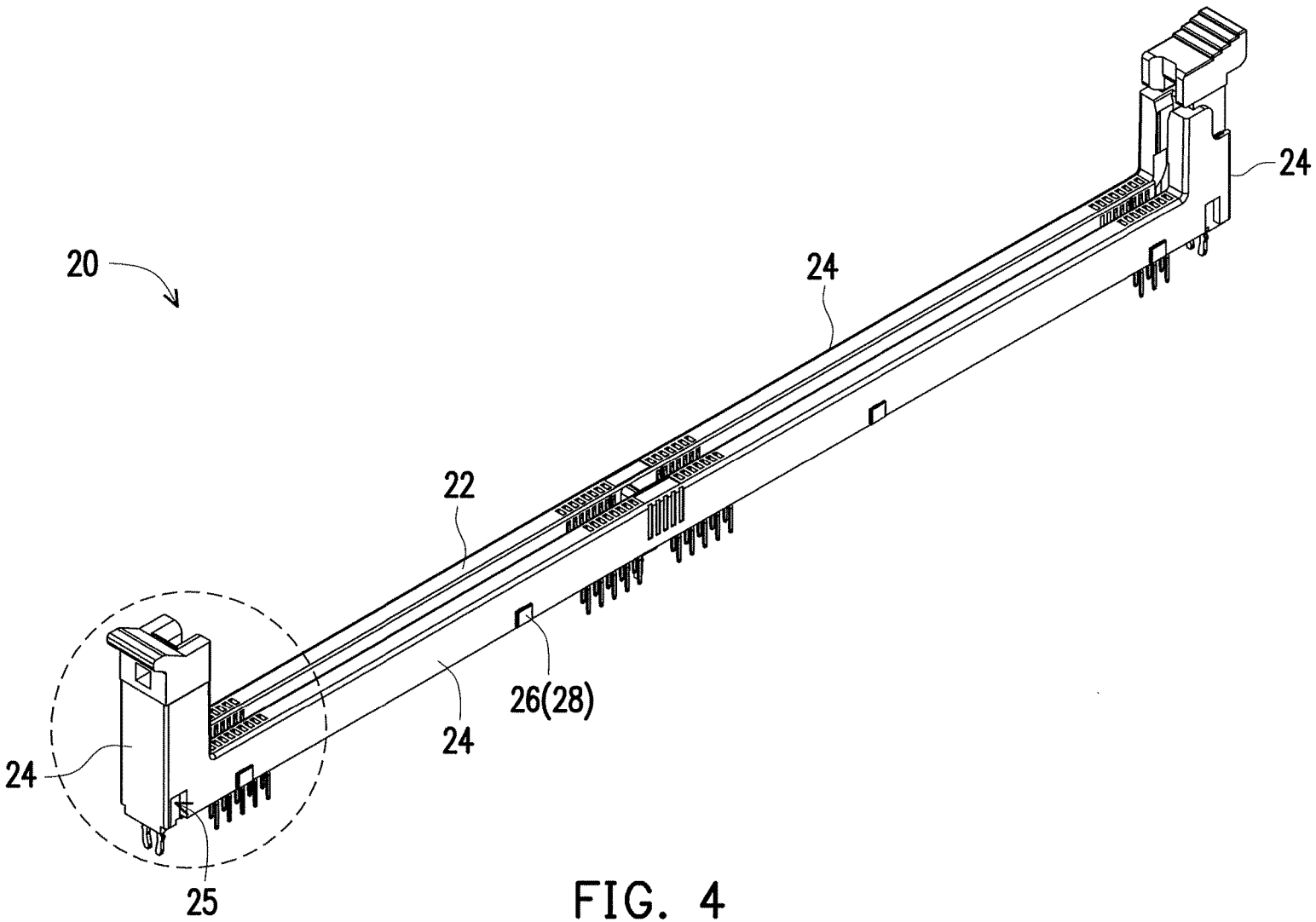
FIG. 4 is a schematic view illustrating a connector of the connector module of FIG. 2.
Figure 5:
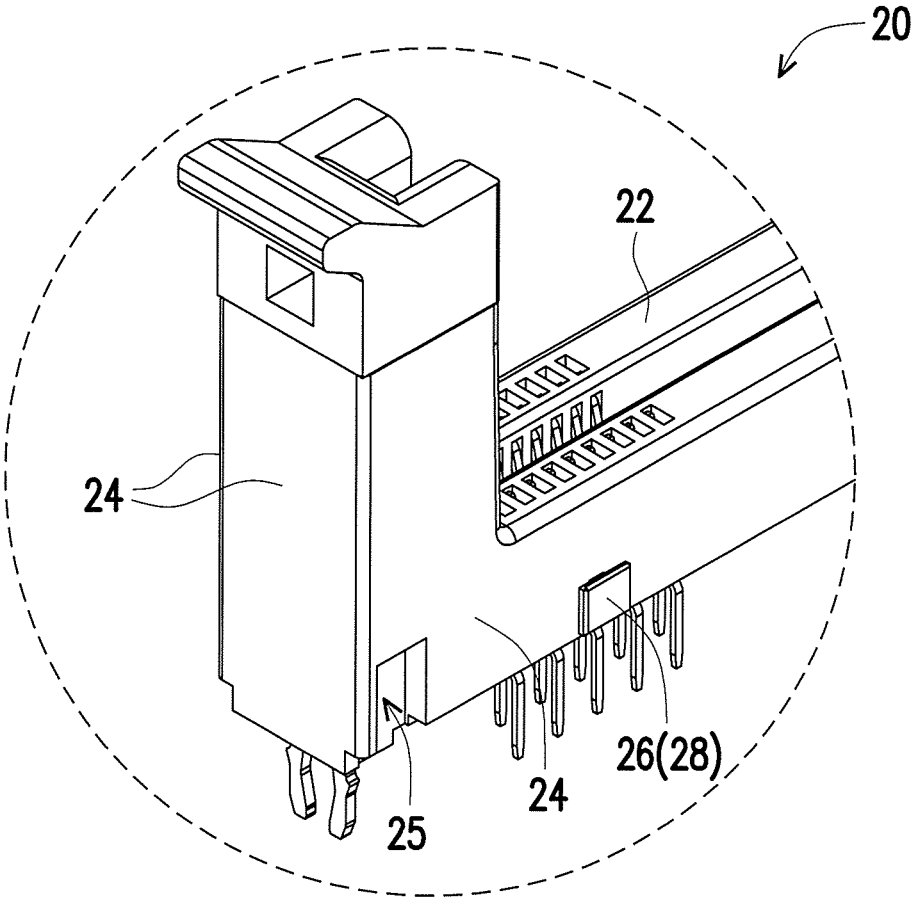
FIG. 5 is a partially enlarged schematic view of FIG. 4.
Figure 6:
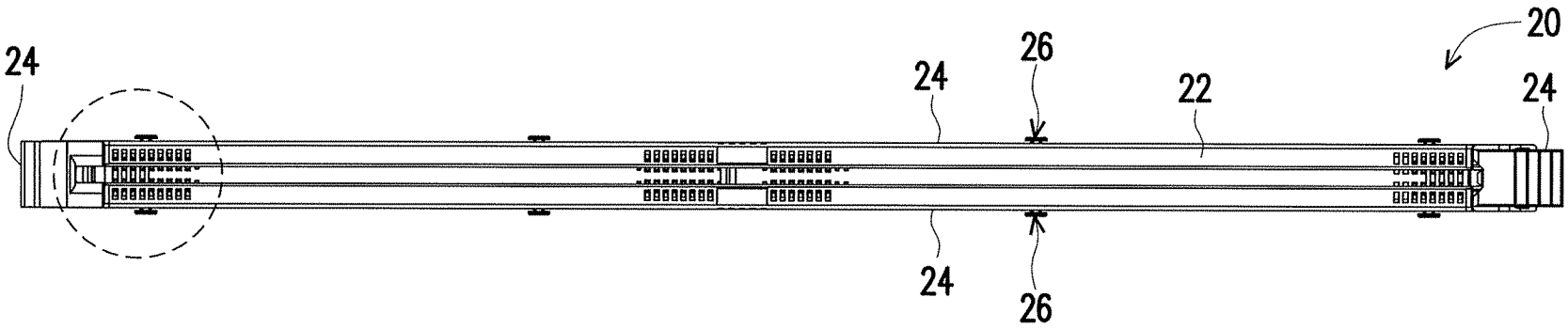
FIG. 6 is a schematic view of FIG. 4 from another perspective.
Figure 7:
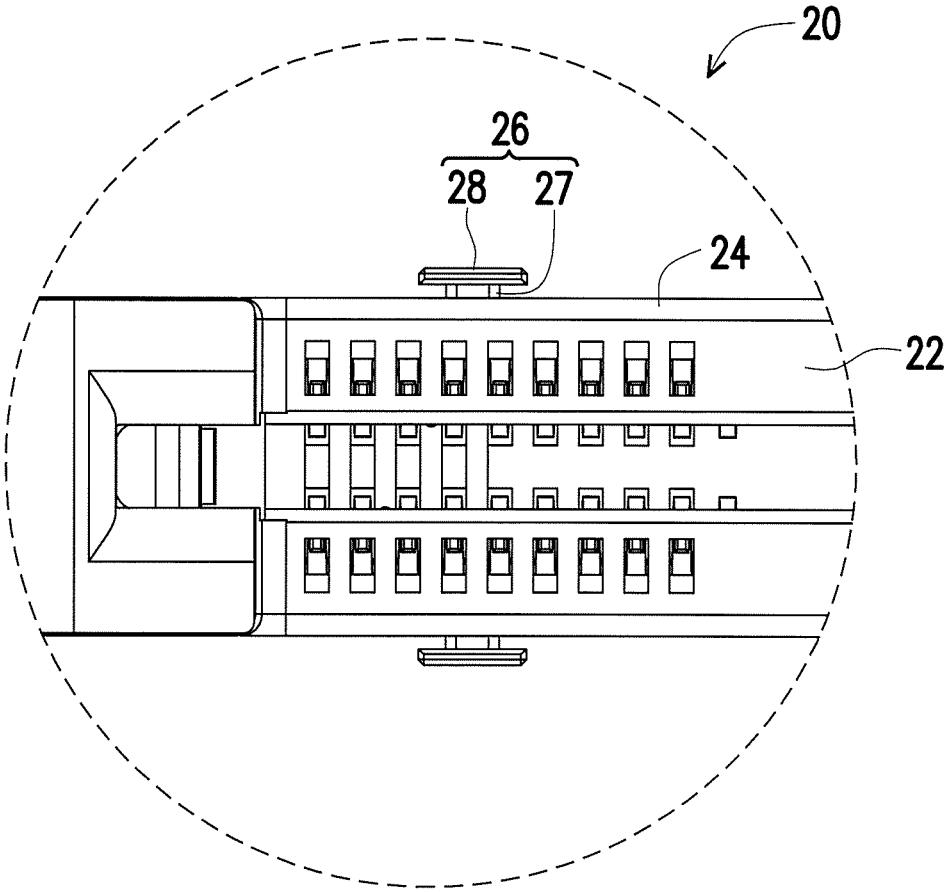
FIG. 7 is a partially enlarged schematic view of FIG. 6.

FIG. 4 is a schematic view illustrating a connector of the connector module of FIG. 2. FIG. 5 is a partially enlarged schematic view of FIG. 4. FIG. 6 is a schematic view of FIG. 4 from another perspective. FIG. 7 is a partially enlarged schematic view of FIG. 6. Referring to FIGS. 4 to 7, in this embodiment, the connector 20 includes a connector top surface 22, four connector laterals 24 connected to each other, and at least one fixing member 26. The connector top surface 22 includes a connector slot. The connector slot is provided for detachable insertion of a memory module (not shown), such that the memory module is electrically connected with a motherboard (not shown).

In this embodiment, two relatively longer connector laterals 24 are connected to the connector top surface 22, and the four connector laterals 24 form an enclosed elongated rectangle. The at least one fixing member 26 protrudes from one of the connector laterals 24 and is located at a position away from the connector top surface 22 on the connector lateral 24. More specifically, in this embodiment, the connector 20 includes eight fixing members 26. The eight fixing members 26 are disposed on two longer connector laterals 24 (each of the longer connector laterals 24 has four fixing members 26) and located on the connector lateral surfaces 24 at positions away from the connector top surface 22 (i.e., positions closer to the bottom).

As shown in FIG. 7, each fixing member 26 includes a base portion 27 and a top board 28 located on the base portion 27. A width of the top board 28 is greater than a width of the base portion 27, such that the top board 28 and the base portion 27 are in a form of T-shaped column. The fixing part 26 is connected to the connector lateral 24 through the base portion 26, and an extending direction of the top board 28 is parallel to an extending direction of the corresponding connector lateral 24. As shown in FIGS. 4 and 6, on each of the longer connector laterals 24, two of the fixing members 26 are located at positions near left and right ends on the connector lateral 24, while the other two fixing members 26 are evenly distributed between the fixing members 26 near the left and right ends. It should be noted that, while the number of the fixing members 26 in each of the longer connector laterals 24 is described as four, the number of the fixing members 26 is not limited thereto. In other embodiments, if the number of the fixing members 26 is only two, the two fixing members 26 are preferably located at the positions near the left and right ends of the connector laterals 24. Of course, the fixing members 26 may also be disposed at positions near the center. In other embodiments, the number of the fixing member 26 may also be one.

Figure 8:
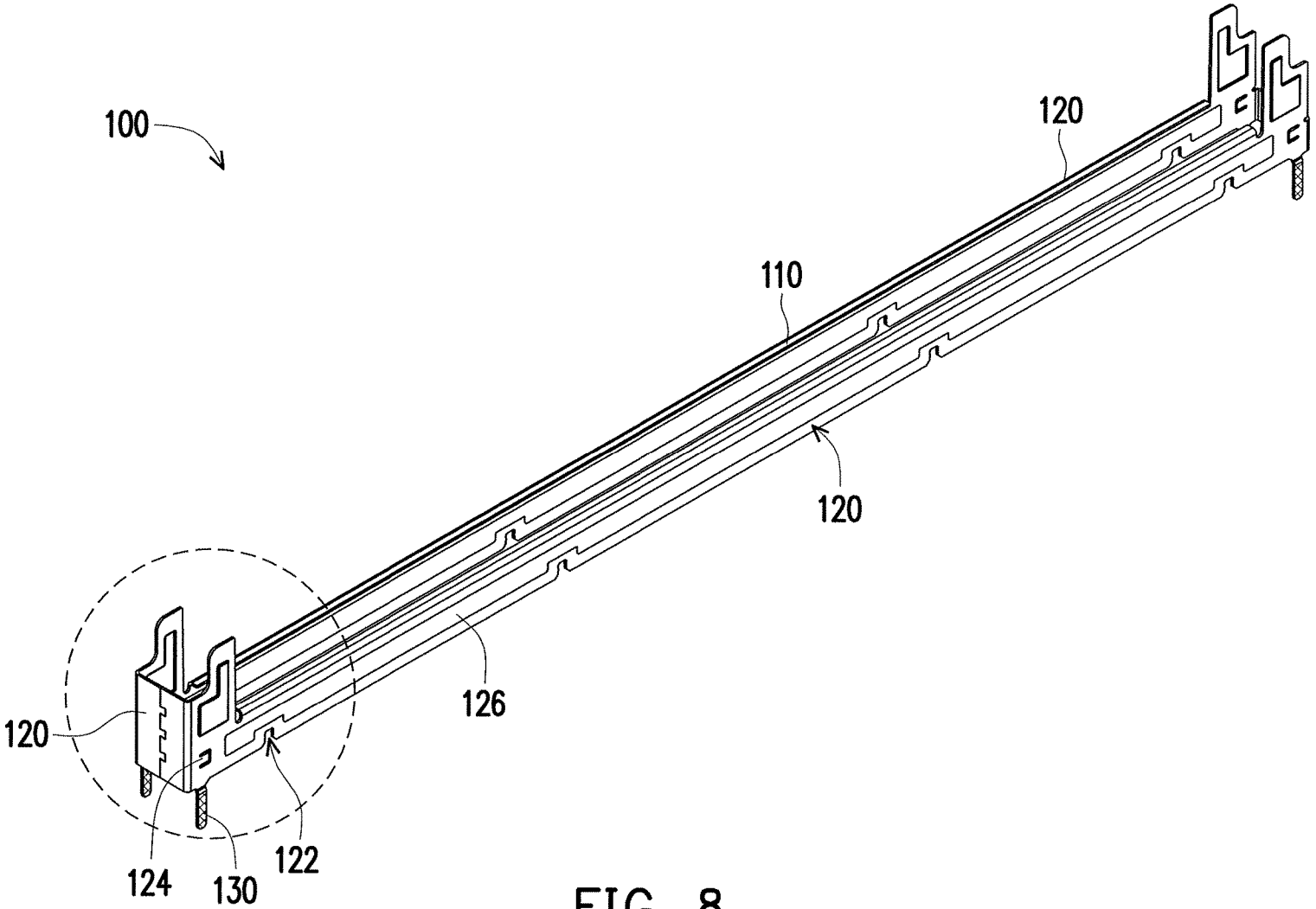
FIG. 8 is a schematic view illustrating a connector cover of the connector module of FIG. 2.
Figure 9:
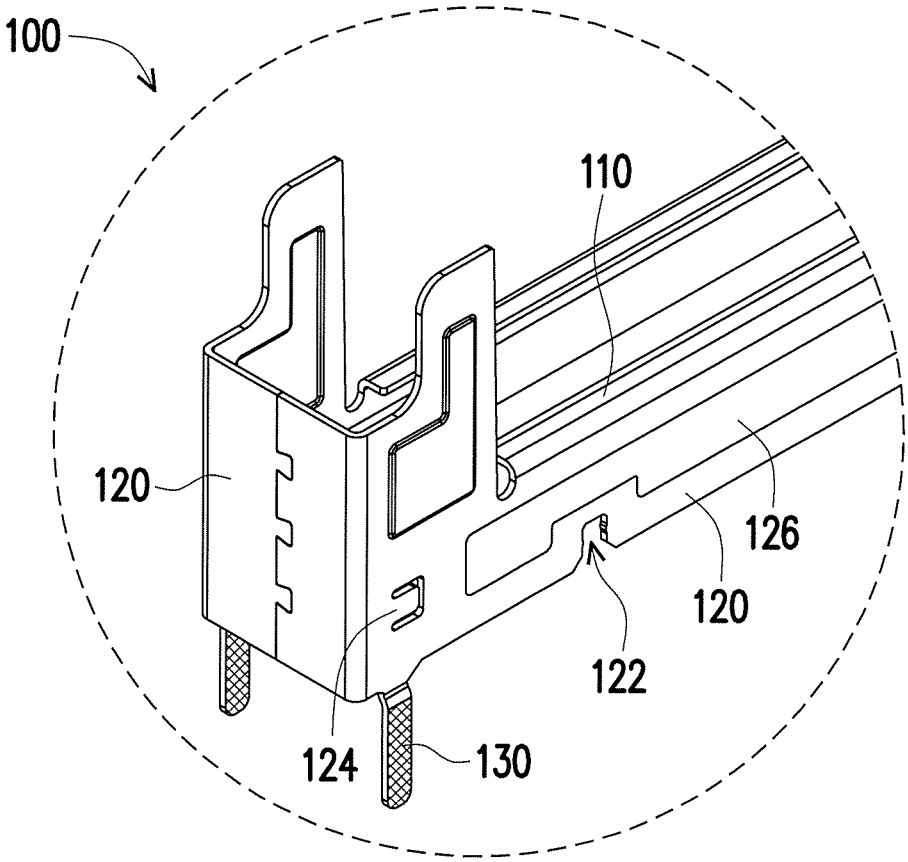
FIG. 9 is a partially enlarged schematic view of FIG. 8.

FIG. 8 is a schematic view illustrating a connector cover of the connector module of FIG. 2. FIG. 9 is a partially enlarged schematic view of FIG. 8. Referring to FIGS. 8 and 9, in this embodiment, the connector cover 100 includes a cover top surface 100 and four cover laterals 120. The cover top surface 110 covers the connector top surface 22, and includes a groove corresponding to the connector slot. More specifically, in this embodiment, the cover top surface 110 only covers a partial area of the connector top surface 22 close to the two longer connector laterals 24. Thus, a width of the groove of the cover top surface 110 is greater than a width of the connector slot of the connector top surface 22, making a portion of the connector top surface 22 exposed by the cover top surface 110. Of course, in other embodiments, the cover top surface 110 may also cover the whole connector top surface 22 with only the connector slot exposed. The form of the cover top surface 110 is not limited thereto.

The four cover laterals 120 cover the four connector laterals 24. The four cover laterals 120 are connected to each other to form an enclosed elongated rectangle. In addition, two relatively longer cover laterals 120 are connected to the cover top surface 110. In this embodiment, the cover laterals 120 are formed by bending at least one metal sheet, and two ends of the at least one metal sheet are bonded at a shorter cover lateral 120. In this embodiment, the whole connector cover 100 is forming by bending a metal sheet. As shown in FIGS. 8 and 9, two ends of the metal sheet are bonded at a shorter cover lateral 120 (i.e., the cover lateral 120 at the left side in the drawings). More specifically, profiles of the two ends of the metal sheet include a protruding part and a recessed part whose shapes match each other. When the two ends are assembled together, the two ends may be fixed by pressing, soldering, or riveting. Of course, in other embodiments, the connector 100 may also be formed by bending two metal sheets together. The ends of the metal sheets may also be respectively bonded at two shorter cover laterals 120.

Through experimentation, it is learned that, if two longer connector laterals of a slot of a conventional connector 2 are pulled in directions away from each other, an average pulling force that the conventional connector 2 is able to take is about 55.98 kilograms. If a connector cover of a connector module only has two relatively longer cover laterals without shorter cover laterals, namely the cover laterals of the connector cover are not connected to each other and do not form an enclosure, an average pulling force that the connector module is able to take is about 63.9 kilograms. In this embodiment, the four cover laterals 120 of the connector cover 100 are connected and form an enclosed elongated rectangle, and an average pulling force that the connector module 10 is able to take is about 97.425 kilograms. Accordingly, the configuration where the cover laterals 120 of the connector cover 100 are connected to each other significantly increases a capability of the connector module 10 against a pulling force, making the connector module 10 less easy to crack.

Besides, at least one of the cover laterals 120 includes at least one concave 122 away from the cover top surface 110. In this embodiment, the two longer cover laterals 120 respectively include a plurality of the concaves 122. More specifically, each of the longer cover laterals 120 includes four concaves 122. The number of the concaves 122 corresponds to the number of the fixing members 26. In addition, positions of the concaves 122 on the cover laterals 120 correspond to the positions of the fixing members on the connector laterals 24. Namely, in this embodiments, two of the concaves 122 are located at positions near left and right ends of the cover lateral, and the other two concaves 122 are evenly distributed between the concaves 122 near the left and right ends. Similarly, since the number and positions of the concaves 122 correspond to the number and positions of the fixing members 26, the number and positions of the concaves 122 are not limited thereto.

It should be noted that, in this embodiment, two of the fixing members 26 are located at the positions near the left and right ends of the connector lateral 24, and two of the concaves 122 are located at the positions near the left and right ends of the cover lateral 120. Such configuration makes it less easy to pull the longer cover laterals 120 in directions away from each other and separate the longer cover laterals 120 from the connector laterals 24.

Figure 10:
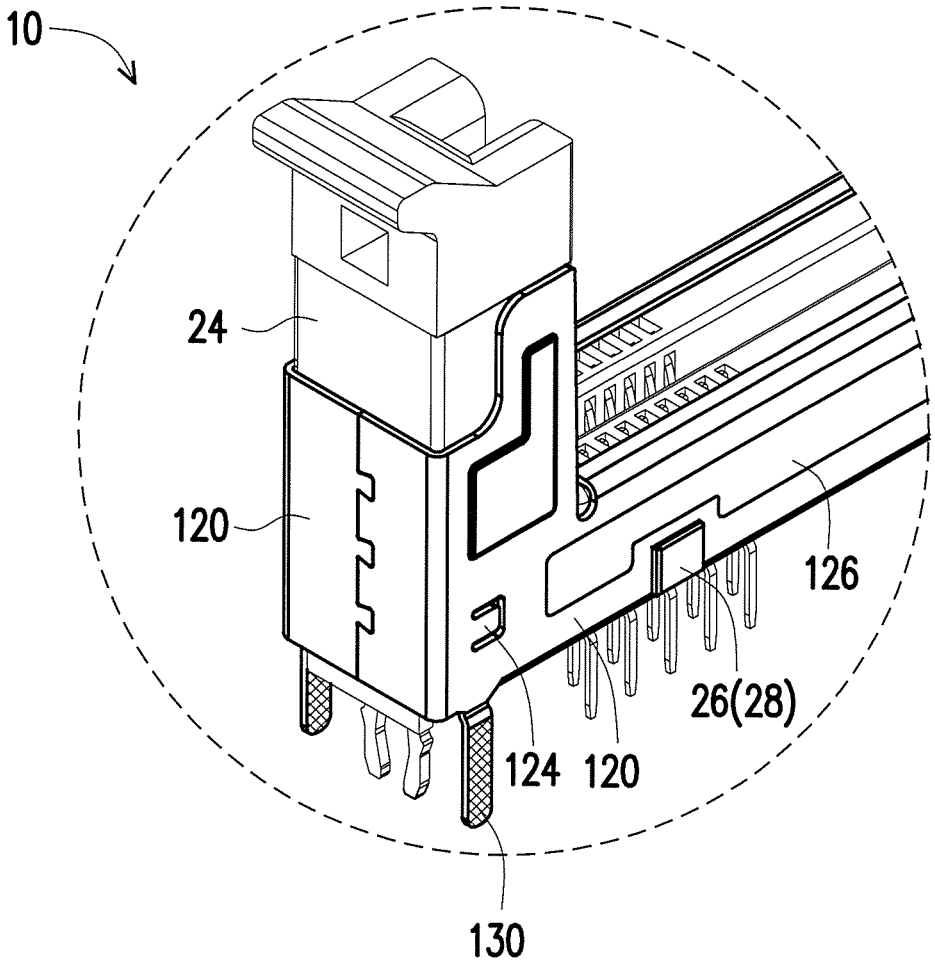
FIGS. 10 and 11 are respectively partially enlarged schematic views of FIGS. 2 and 3.
Figure 11:
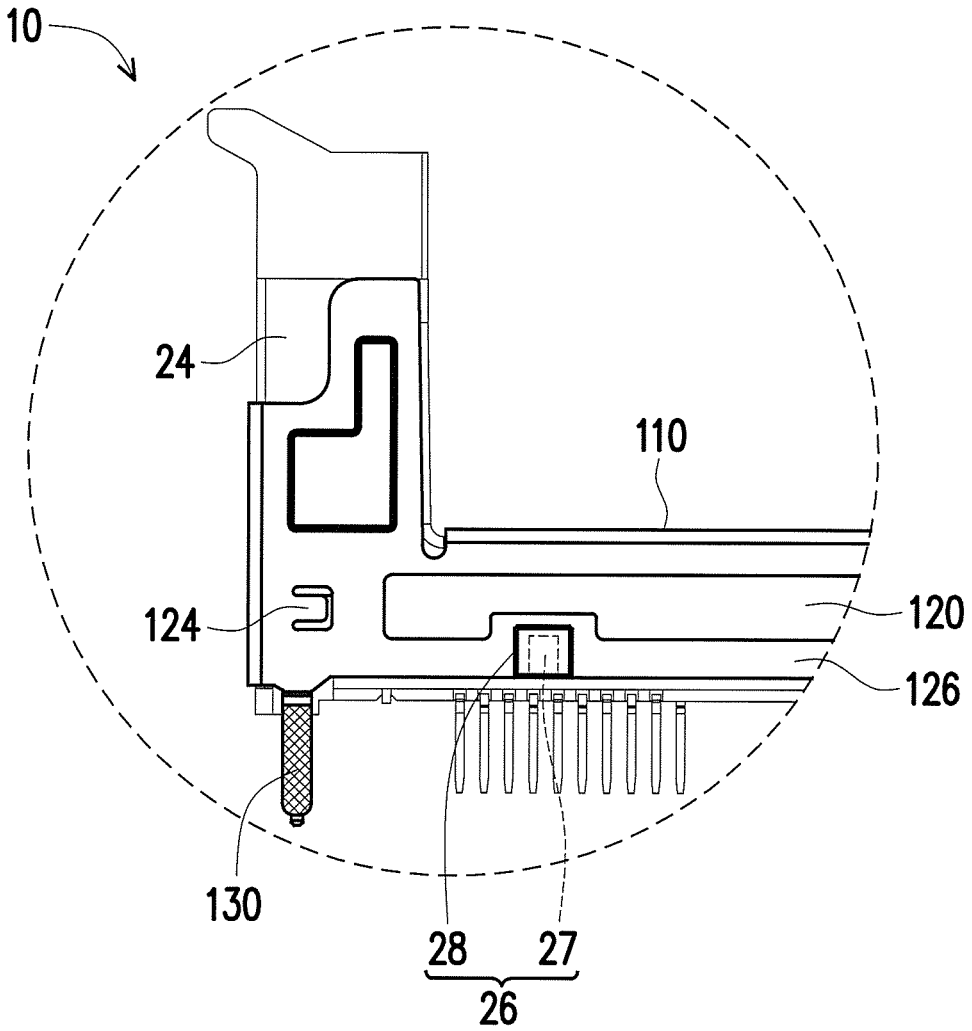

FIGS. 10 and 11 are respectively partially enlarged schematic views of FIGS. 2 and 3. Referring to FIGS. 2, 3, 10, and 11 together, when the connector cover 100 is assembled to the connector 20, the cover top surface 110 of the connector cover 100 comes into contact against the connector top surface 22 of the connector 20. The four connector laterals 120 of the connector cover 100 respectively lean against the four connector laterals 24 of the connector 20. Thus, the connector cover 100 is able to protect the connector 20.

Moreover, in this embodiment, since a width of the concave 122 is close to the width of the base portion 27, when the connector cover 100 is assembled to the connector 20, portions of the cover lateral 120 near two sides of the concave 122 may slide into two recesses at two sides of the T-shaped column formed by the top board 28 and the base portion 27, thereby being embedded into the fixing member 26. Consequently, the base portion 27 of the fixing member 26 is located in the concave 122 of the cover lateral 120, and the cover lateral 120 is limited between the top board 28 of the fixing member 26 and the connector lateral 24 to prevent the cover lateral 120 from being easily pulled away from the connector lateral 24.

Figure 1B:
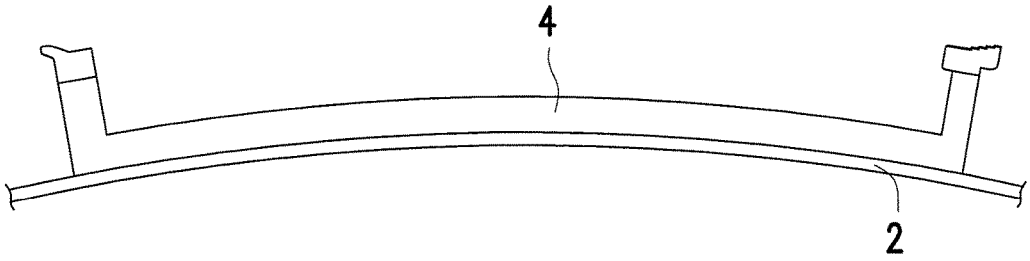
FIG. 1B(RELATED ART)

Also, in an exemplary embodiment, since the width of the concave 122 is close to the width of the base portion 27, two opposing walls of the cover lateral 120 beside the concave 122 lean against two sides of the base portion 27 on the connector lateral 24. Thus, two sides of the cover lateral 120 cannot be easily bent upward or downward with respect to the center. In other words, the two sides of the cover lateral 120 may not be easily bent upward or downward as in FIGS. 1A and 1B. Consequently, the connector cover 100 of the embodiment is capable of increasing an anti-bending ability of the connector 20. Since the connector module 10 may not be bent easily when the connector module 10 is fixed on motherboard, even if a component (not show) such as the fan of the central processing unit is engaged to the motherboard, the motherboard is less likely to be bent excessively due to a strong engaging force of the fan because the position of the connector module 10 is near the position of the fan. In other words, the connector module 10 of this embodiment is further capable of alleviating bending of the motherboard.

It should be noted herein that, due to a tolerance in the manufacturing process, the width of the concave 122 may still be slightly greater than the width of the base portion 27 in order to smoothly assemble the connector cover 100 to the connector 20 and to dispose the base portion 27 in the concave 122. Thus, the opposing walls of the cover lateral 120 beside the concave 122 may not be completely attached to the sides of the base portion 27 on the connector lateral 24. However, the opposing walls of the cover lateral 120 beside the concave 122 are still very close to the sides of the base portion 27, such that when two sides of the cover lateral 120 with respect to the center undertake an upward or downward bending force, the opposing walls of the cover lateral 120 beside the concave 122 are limited by the sides of the base portion 27, so as not to be deformed significantly.

Furthermore, one of the longer connector laterals 24 of the connector 20 includes a recessed part 25, and one of the longer cover laterals 120 of the connector cover 100 includes a suspending arm 124. In this embodiment, each of the longer connector laterals 24 includes two recessed parts 25 (as shown in FIG. 4) at positions near the left and right ends, and each of the longer cover laterals 120 includes two suspending anus 124 (FIG. 8) at positions near the left and right ends. The suspending arm 124 is bent toward the recessed part 25 to come into contact against the recessed part 25. In this embodiment, the suspending arms 124 at the sides extend toward the center. The suspending arms 124 may not be bent during assembling, and may be bent to be inserted into the recessed parts 25 through knocking when the connector cover 100 is assembled to the connector 20. The suspending arm 124 may be inclined or vertical with respect to the adjacent cover lateral 120, and the invention does not intend to impose a limitation on the angle.

In other embodiments, the suspending arm 124 may also extend toward the top of the figure. Under such circumstance, the suspending arm 124 may be bent with respect to the adjacent cover lateral 120 before assembling. The suspending arm 124 may be pushed out by the connector lateral 24 during assembling and slide into the recessed part 25 after assembling. An extending direction and a bending angle of the suspending arm 124 are not limited, as long as the connector cover 100 is fixed to the connector 20.

With such arrangement, in this embodiment, when the connector cover 100 is disposed on the connector 20, the four cover laterals 120 lean against the four connector laterals 24 to prevent forward/backward and leftward/rightward movements between the connector cover 100 and the connector 20. The base portions 27 of the fixing members 26 are located in the concaves 122 of the cover laterals 120, and the cover laterals 120 are also limited between the top boards 28 and the connector laterals 24. Thus, the cover laterals 120 may be prevented from being easily pulled away from the connector laterals 24, and the stability of the cover laterals 120 leaning against the connector laterals 24 may be consequently reinforced. The cover laterals 110 leaning against the connector top surface 22 prevents the connector cover 100 from being moved downward easily with respect to the connector 20. Upper ends of the suspending arms 124 in the figure come into contact against upper walls of the concaves 25. Thus, the connector cover 100 is not easily moved upward and detached from the connector 10.

In addition, the connector cover 100 includes at least one connection pin 130 extending from one of the cover laterals 120. More specifically, in this embodiment, the connector cover 100 includes four connection pins 130. The connection pins 130 are arranged in pairs and respectively extend from the opposing cover laterals 120 toward a direction away from the cover top surface 110. The connector cover 100 of this embodiment is connected and fixed to the motherboard through the connection pins 130. In other words, the connector cover 100 of this embodiment is fixed to the motherboard through the connection pins 130 as well as pins of the connector 20 (e.g., by inserting the connection pins 130 and the pins of the connector 20 into corresponding holes on the motherboard and filling a soldering material), such that the connector cover 100 is able to be more firmly disposed on the connector 20. Of course, the number and positions of the connection pins 130 are not limited thereto.

In this embodiment, the connection pin 130 has a rough surface capable of reinforcing adhesion of the soldering material. In this embodiment, there may be a plurality of rhombus protrusions on the rough surface. Thus, the surface is uneven and exhibits roughness. The rough surface may be formed by performing a punching process. However, in other embodiments, the rough surface may be formed by forming regular or irregular patterns on the connection pin 130 by scratching. Alternatively, the rough surface may also be formed by performing a blasting process on the connection pin 130. A form and a formation process of the rough surface on the connection pin 130 are not limited thereto.

Of course, in other embodiments, a fixing strength between the connection pin 130 and the motherboard may be reinforced in a different way. For example, a bending part that is pressed but not cut or a breach that is cut may be formed on the connection pin 130 through pressing. When the connection pin 130 is to be fixed to the motherboard, some soldering material may be at a position where the bending part is recessed or at the breach. Thus, the fixing strength between the connection pin 130 and the motherboard may be further reinforced.

It should be noted that, in this embodiment, the connection pins 130 are ground pins. In other words, when the connection pins 130 are fixed to the motherboard, the connection pins 130 may contact a grounding wire of the motherboard, so as to be grounded. Namely, in addition to the fixing function, the connection pins 130 of the connector cover 100 also offers protection against electromagnetic interference for the connector 20.

In addition, in this embodiment, a thickness of the connector cover 100 is limited to prevent an area on the motherboard from being reduced due to the connector cover 100 arranged on the connector 20. For example, in this embodiment, a thickness of the connector cover 100 is approximately 0.15 millimeters. However, since a metal plate with such thickness has a lower stiffness, the cover lateral 120 of the connector cover 100 is specifically designed to allow the connector cover 100 with a thinner thickness to have a strength sufficient to protect the connector 20.

More specifically, in this embodiment, each of the two longer cover laterals 120 includes a plurality of discontinuous protruding ribs 126. Since the stiffness of metal is increased after the metal is bent and pressed, an overall structural strength of the connector cover 100 of this embodiment is further reinforced by using the bent ribs 126. Of course, in other embodiments, the ribs 126 may also be recessed. Besides, even though each of the longer cover laterals 120 in this embodiment includes the discontinuous ribs 126, each cover lateral 120 may also include one longer rib 126 in other embodiments. The form, number, and position of the rib 126 are not limited by the drawings.

In view of the foregoing, the connector cover according to the embodiments of the invention includes the cover laterals leaning against the connector laterals and the cover top surface leaning against the connector top surface. Therefore the connector module has a preferable strength. Moreover, the fixing member of the connector protrudes from the connector lateral in the form of T-shaped column, the cover lateral of the connector cover has the concave at the position corresponding to the fixing member, and the width of the concave is close to the width of the base portion of the fixing member. Thus, when the connector cover is assembled to the connector, the base portion of the fixing member is located in the concave of the cover lateral, such that the cover lateral is limited between the top board of the fixing member and the connector lateral, thereby preventing the cover lateral from being easily pulled away from the connector lateral. Moreover, since the opposing walls of the cover lateral beside the concave are near or lean against the opposing sides of the base portion located on the connector lateral, the two sides of the cover lateral with respect to the center cannot be easily bent upward or downward. Thus, the connector cover is capable of increasing an anti-bending ability of the connector. If the connector module is fixed on the motherboard, the connector module may also alleviate bending of the motherboard.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A connector cover, adapted to cover a connector, wherein the connector comprises a connector top surface, four connector laterals connected to each other, and a fixing member, the fixing member protrudes from one of the connector laterals and is located on the connector lateral at a position away from the connector top surface, the fixing member comprises a base portion and a top board located on the base portion, the top board and the base portion are in a form of a T-shaped column, and the fixing member is connected to the connector lateral through the base portion, the connector cover comprising:

a cover top surface; and four cover laterals, wherein one of the cover laterals comprises a concave at a position away from the cover top surface, the position of the concave on the cover lateral corresponds to the position of the fixing member on the connector lateral, and a width of the concave is close to a width of the base portion, when the connector cover is assembled to the connector, the four cover laterals of the connector cover respectively lean against the four connector laterals of the connector, the base portion of the fixing member is located in the concave of the cover lateral, and walls beside the concave are near or lean against the base portion, wherein a longer connector lateral of the connector laterals of the connector comprises a recessed part, a longer cover lateral of the cover laterals of the connector cover comprises a suspending arm, and the suspending arm is bent toward the recessed part to come into contact against the recessed part.

2. The connector cover as claimed in claim 1, wherein the connector comprises two of the fixing members, the two fixing members are located at positions near left and right ends of the connector lateral, one of the cover laterals comprises two of the concaves, and the two concaves are located at positions near left and right ends of the cover lateral.

3. The connector cover as claimed in claim 1, wherein the four cover laterals are formed by bending at least one metal sheet, and two ends of the at least one metal sheet is bonded at a shorter cover lateral of the cover laterals.

4. The connector cover as claimed in claim 1, further comprising:

at least one connection pin, extending from one of the cover laterals in a direction away from the cover top surface, wherein the connector cover is adapted to be connected to a motherboard through the at least one connection pin.

5. The connector cover as claimed in claim 4, wherein the at least one connection pin is a ground pin, and each connection pin has a rough surface, a bending part, or a breach, and the rough surface comprises a blasted surface or comprises a plurality of regular or irregular strips or bumps.

6. A connector module, comprising:

a connector, comprising:

a connector top surface;

four connector laterals connected to each other; and a fixing member, protruding from one of the connector laterals and located on the connector lateral at a position away from the connector top surface, wherein the fixing member comprises a base portion and a top board located on the base portion, the top board and the base portion are in a form of a T-shaped column, and the fixing member is connected to the connector lateral through the base portion; and a connector cover, comprising:

a cover top surface; and four cover laterals, connected to each other, wherein one of the cover laterals comprises a concave at a position away from the cover top surface, the position of the concave on the cover lateral corresponds to the position of the fixing member on the connector lateral, and a width of the concave is close to a width of the base portion, when the connector cover is assembled to the connector, the four cover laterals of the connector cover respectively lean against the four connector laterals of the connector, the base portion of the fixing member is located in the concave of the cover lateral, and walls beside the concave are near or lean against the base portion, wherein a longer connector lateral of the connector laterals of the connector comprises a recessed part, a longer cover lateral of the cover laterals of the connector cover comprises a suspending arm, and the suspending arm is bent toward the recessed part to come into contact against the recessed part.

7. The connector module as claimed in claim 6, wherein the connector comprises two of the fixing members, the two fixing members are located at positions near left and right ends of the connector lateral, one of the cover laterals comprises two of the concaves, and the two concaves are located at positions near left and right ends of the cover lateral.

8. The connector module as claimed in claim 6, wherein the four cover laterals are formed by bending at least one metal sheet, and two ends of the at least one metal sheet is bonded at a shorter cover lateral of the cover laterals.

9. The connector module as claimed in claim 6, wherein the connector cover further comprises:

at least one connection pin, extending from one of the cover laterals in a direction away from the cover top surface, wherein the connector cover is adapted to be connected to a motherboard through the at least one connection pin.

10. The connector module as claimed in claim 9, wherein the at least one connection pin is a ground pin, and each connection pin has a rough surface, a bending part, or a breach, and the rough surface comprises a blasted surface or comprises a plurality of regular or irregular strips or bumps.

* * * * *